US008665437B2

(12) United States Patent
Fischer et al.

(10) Patent No.: US 8,665,437 B2
(45) Date of Patent: Mar. 4, 2014

(54) METHOD OF CONTROLLING A TRANSFORMATION PROCESS OF CHARGE MATERIAL TO A PRODUCT

(75) Inventors: Harald Fischer, Linz (AT); Heinrich Rochus Mali, Leoben (AT); Johannes Leopold Schenk, Linz (AT); Stefan Schuster, Stans (AT); Bernhard Hailu Spuida, Leoben (AT); Kurt Wieder, Schwertberg (AT); Franz Winter, Baden (AT)

(73) Assignee: Siemens Vai Metals Technologies GmbH (AT)

( * ) Notice: Subject to any disclaimer, the term of this patent is extended or adjusted under 35 U.S.C. 154(b) by 228 days.

(21) Appl. No.: 12/996,421

(22) PCT Filed: May 7, 2009

(86) PCT No.: PCT/EP2009/055545

§ 371 (c)(1),
(2), (4) Date: Feb. 7, 2011

(87) PCT Pub. No.: WO2009/146994

PCT Pub. Date: Dec. 10, 2009

(65) Prior Publication Data

US 2011/0170114 A1 Jul. 14, 2011

(30) Foreign Application Priority Data

Jun. 6, 2008 (AT) ..... A 921/2008

(51) Int. Cl.

| | |
|---|---|
| ***C10G 1/06*** | (2006.01) |
| ***C10G 1/00*** | (2006.01) |
| ***C10G 1/04*** | (2006.01) |
| ***C09K 8/52*** | (2006.01) |

(52) U.S. Cl.

USPC ..... 356/368; 208/400; 208/402; 208/428; 507/90

(58) Field of Classification Search

USPC ..... 356/368, 367; 359/246, 281, 483.01; 376/75; 446/75; 507/75; 423/439

See application file for complete search history.

(56) References Cited

U.S. PATENT DOCUMENTS 5,073,194 A * 12/1991 Stephens et al. ..... 75/376
5,366,897 A * 11/1994 Hager et al. ..... 436/55

(Continued)

FOREIGN PATENT DOCUMENTS

EP 0375282 A2 6/1990
JP 62-205233 9/1987

(Continued)

OTHER PUBLICATIONS

Zheng. Melting behavior of single two-dimensional crystal. Feb. 21, 2006, The American Physical Society.*

(Continued)

*Primary Examiner* — Tarifur Chowdhury
*Assistant Examiner* — Maurice Smith
(74) *Attorney, Agent, or Firm* — Ostrolenk Faber LLP

(57) ABSTRACT

A method for controlling a transformation process in which the conversion of charge materials to a product takes place along a transformation interface from the crystal and/or grain and/or phase and/or pore surface into the charge material, wherein one or more chemical elements in the charge materials is released and/or incorporated and/or rearranged and wherein the conversion of the charge materials takes place along advancing transformation interfaces. The charge materials are identified on the basis of at least one optical, in particular microscopic, analysis with respect to their phases and/or phase components and/or their phase morphology, structure, texture and/or their chemical composition. On the basis of these variables, reference functions for the charge materials, which describe the conversion of the charge materials in the process, are assigned and used for establishing the process parameters of the transformation process.

9 Claims, 2 Drawing Sheets

(56) References Cited

U.S. PATENT DOCUMENTS

| | | | | |
|---|---|---|---|---|
| 6,141,093 | A * | 10/2000 | Argyle et al. | 356/237.1 |
| 7,420,675 | B2 * | 9/2008 | Giakos | 356/364 |
| 7,662,207 | B2 | 2/2010 | Miura et al. | 75/246 |
| 7,708,864 | B2 * | 5/2010 | Brons et al. | 201/1 |
| 2006/0014296 | A1 * | 1/2006 | Brons et al. | 436/171 |
| 2008/0291463 | A1 * | 11/2008 | Milner et al. | 356/491 |

FOREIGN PATENT DOCUMENTS

| | | | |
|---|---|---|---|
| JP | 3-257107 | A | 11/1991 |
| JP | 11-087455 | | 3/1999 |
| JP | 11-106807 | A | 4/1999 |
| JP | 2003-201508 | A | 7/2003 |
| JP | 2007-277630 | A | 10/2007 |
| RU | 2040796 | C1 | 7/1995 |
| RU | 2133173 | C1 | 7/1999 |
| UA | 77 107 | C2 | 6/2005 |
| WO | WO 2007/027998 | A2 | 3/2007 |

OTHER PUBLICATIONS

Stevens. Mossbauer Spectroscopy. Apr. 5, 1978, Analytical Chemistry vol. 50.*

X. H. Zheng .“Melting behavior of single two-dimensional crystal”. Feb. 21, 2006. The American Physical Society. p. 1-4.*

Olafsen.“Clustering, Order, and Collapse in a Driven Granular Monolayer” Jun. 3, 1998 The American Physical Society p. 1.*

A. Thurnhofer, et al. “Iron Ore Reduction in a Continuously Operated Multistage Lab-Scale Fluidized Bed Reactor-Mathematical Modeling and Experimental Results,” Metallurgical and Materials Transactions B, vol. 37B, Aug. 2006, pp. 665-673.

J. Janowski, et al., “Evolution of Porosity Profiles of Magnetite Phase During High Temperature Reduction of Hematite,” ISIJ International, vol. 36, No. 3, 1996, pp. 269-278.

A. Kilpinen, “Adaptive On-Line Model for Detecting the Cohesive Zone Level in Blast Furnace,” In: M. H. Hamza: Proceedings of the IASTED Int. Symposium. Modeling Identification and Control—MIC ’88, 1988, pp. 257-260.

J. Mitterlehner, et al., “Modeling and Simulation of Heat Front Propagation in the Iron Ore Sintering Process,” ISIJ International, vol. 44, No. 1, 2004, pp. 11-20.

Database Compendex [Online] Engineering Information, Inc., El-Geassy A A, “Stepwise Reduction of CaO and/or MgO Doped-Fe2O3 Compacts to Magnetite Then Subsequently to Iron at 1173-1473K,” 1997, one page.

International Search Report dated Sep. 23, 2009, issued in corresponding international application No. PCT/EP2009/055545.

* cited by examiner

METHOD OF CONTROLLING A TRANSFORMATION PROCESS OF CHARGE MATERIAL TO A PRODUCT

CROSS-REFERENCE TO RELATED APPLICATIONS

The present application is a 35 U.S.C. §§371 national phase conversion of PCT/EP2009/055545, filed May 7, 2009, which claims priority of Austrian Application No. A921/2008 filed Jun. 6, 2008, the contents of which are incorporated by reference herein. The PCT International Application was published in the English language.

BACKGROUND OF THE INVENTION

The invention relates to a method for controlling a transformation process in which the conversion of charge materials to a product takes place along a transformation interface from the crystal and/or grain and/or phase and/or pore surface into the charge material, wherein one or more chemical elements in the charge materials is released and/or incorporated and/or rearranged and the conversion of the charge materials taking place along advancing transformation interfaces.

The method may also be used for example for controlling a metallurgical process, in particular a reduction process, using process gases for producing metals and/or primary metallurgical products and/or intermediate metallurgical products on the basis of charge materials, in particular ores, auxiliaries, additions and solid carbon carriers.

Metallurgical processes using process gases are widely used. They involve using, for example, the reduction potential or the oxidation potential of a process gas in the conversion of the charge materials. The metals, primary metallurgical products or intermediate metallurgical products or mixtures thereof that are produced in the process are the result of the conversion. In the case of such processes, there is the necessity to adapt the process parameters to the charge materials, since the conversion depends on their chemical, physical and thermodynamic properties.

JP 3-257107 discloses that, before it is charged into a blast furnace, raw material is captured on camera and the grain size distribution is thereby analyzed. A disadvantage of this is that there is no identification of the charge materials.

SUMMARY OF THE INVENTION

It is therefore an object of the invention to provide a method which makes it possible for the transformation process to be controlled as precisely as possible on the basis of the identification of the charge materials and so ensures significantly more efficient conversion of the charge materials in the process.

The object according to the invention is achieved in a way corresponding to the method according to the invention.

With the method according to the invention, the usually solid charge materials can be identified on the basis of at least one optical, in particular microscopic, analysis with respect to their phases and/or phase components and/or their phase morphology and/or their chemical composition. The identification of the charge materials is of particular significance, since, for example, a chemical analysis only allows inadequate findings with respect to the behavior of the charge materials in a metallurgical process. Also of interest in particular is the composition of the charge materials with regard to the constituents thereof, since these so-called phase constituents allow not only the chemical composition but also, for example, the mechanical or thermodynamic properties to be established, so that a transformation process depends to a great extent on the mineralogy and petrography, in particular on the microstructure and the texture of the charge materials.

The constituents of a mineral raw material as a charge material are established by the phases or minerals, the phases usually having regions with a specific chemical composition and a crystalline structure. The term "mineral raw material" also covers synthetically produced materials, such as glasses, which occur for example in sintering, as well as coals and cokes, which essentially do not have a crystalline structure. Metallurgical processes are influenced very strongly by the morphology of the phases and the spatial distribution. The identification of these variables allows reference functions for the charge materials, which describe the conversion of the charge materials in the process, to be assigned and used for establishing the process parameters of the metallurgical process.

It is consequently possible to assess the influence of the charge materials on the basis of their composition, their structure and the morphology of the phases and to describe the conversion to be expected of the charge materials in the process by means of reference functions. This description allows corresponding adaptation or setting of the process parameters, so that the conversion of the charge materials can be set so as to correspond to an objective.

On the basis of the detailed analysis of the charge materials, the behavior to be expected of these charge materials can be determined, facilitating setting of the process parameters. The microscopic analysis may also be used for the purpose of checking transformation processes, such as for example metallurgical or chemical processes, that are in progress and intervening with regard to the conversion of the charge materials, rapid adaptation of the process parameters always being made possible in cases where the composition of the charge materials has changed.

According to an advantageous refinement of the method according to the invention, the process parameters are established on the basis of process variables stored with the reference functions, in such a way that the conversion described with the reference functions is increased, in particular maximized. It is possible by the analysis of the charge materials, the reference functions and the associated process variables to increase or maximize the conversion of the charge materials in the process, since a description of the process and optimum selection of the process parameters is made possible on account of the exact knowledge of the charge materials. The process variables represent parameters which are used for process control. On the basis of the reference curves which describe the process or the processing of the charge materials, it is possible to call up for the charge materials corresponding process variables, which form the basis for the process parameters, so that optimization of the process is possible.

According to a further, preferred refinement of the method according to the invention, the reference functions for the charge materials are determined by thermodynamic simulations of the conversion of the charge materials with allowance for the reaction kinetics and, if appropriate, using empirical data. Such simulations are performed, for example, by means of modeling approaches for gas-solid reactions of individual particles. Classic examples of such modeling approaches are the "shrinking-core model" (ash-core model) or the "grain model". (Literature: J Szekely et al., Academic Press, New York 1976).

The conversion may be, for example, a transformation under a process gas, such as the reduction of an ore in a reduction process. On account of the exact knowledge of the composition of the charge materials, it is possible to calculate or predict the conversion by thermodynamics simulations known per se. For this purpose, the process parameters and the kinetics of the reactions must also be taken into consideration as well as the exact knowledge of the charge materials. It is possible to supplement the simulation by empirical data and so obtain more precise results.

According to an advantageous refinement of the method according to the invention, the reference functions and/or the stored process variables are determined in advance and stored in a databank. By this measure it is possible gradually to build up a database for a process and, when new charge materials or combinations thereof are used, said database is correspondingly adapted or newly determined. In this way it is possible to determine sets of reference curves or process variables which can cover subranges and/or the complete operating range of a metallurgical process or, if need be, can also be extended at any time.

According to an alternative refinement of the method according to the invention, the reference functions determined are further optimized on the basis of the thermodynamic simulations and stored in the databank. The ongoing determination of the reference curves makes it possible for them also to be correspondingly optimized and consequently for the process as a whole to be optimized by means of the process variables, so that the efficient operating range of the metallurgical process can nevertheless be ensured in a wider range of the charge materials.

According to the invention, the method provides that the process parameters of the transformation process are set in such a way that the deviation of the actual conversion of the charge materials into finished products from the conversion of the charge materials described by means of reference functions is minimized. On the basis of optimized reference curves it is possible to operate the metallurgical process in such a way that the reference curves are used as optimum process modes and the process parameters are chosen in such a way that these reference curves are set as accurately as possible. Therefore, the reference curves and associated process variables allow a metallurgical process to be easily optimized.

An advantageous refinement of the method according to the invention is achieved if a thermodynamic simulation of the conversion of the charge materials with allowance for the reaction kinetics takes place online on the basis of the microscopically determined variables for the charge materials and/or the products, if appropriate using empirical data. Then the result of this simulation is compared with the reference functions and an adaptation of the process parameters of the transformation process is performed on the basis of this comparison while minimizing deviations. It is possible by the online simulation to determine very quickly deviations of the actual situation from the desired situation, described by the reference curves, and to adapt the process parameters correspondingly. The reaction kinetics must be taken into consideration thereby, because the thermodynamic equilibria often require a longer time to set, so that the actual reaction equilibrium deviates from the purely thermodynamic viewpoint. Similarly, the use of empirical parameters is advantageous to improve the thermodynamic situation with regard to its accuracy.

According to the invention, the process parameters, in particular pressure, temperature, volume flows of the process gas, preferably a reduction gas, and/or the charge materials, grain size distribution of the charge materials, dwell time of the charge materials in the process and degree of oxidation of the process gases, are adapted in accordance with the results of the microscopic analysis of the charge materials. The intervention in the process consequently takes place directly by changing the process parameters, while on the one hand maintaining predefined ranges of values and taking into account mutual dependences of the parameters on one another.

According to a possible refinement of the method according to the invention, the degree of conversion of the charge materials in the process is established by the degree of reduction and/or by the carbon content of the charge materials. These two variables are uniquely determinable, so that the actual conversion of the charge materials in the process can be registered by measuring instruments by means of technically conventional measures.

According to a special refinement of the method according to the invention, the degree of conversion, in particular the degree of reduction, and/or the carbon content is individually determined for each phase in the charge material and the process parameters are chosen in such a way that the average degree of oxidation of the reduced charge materials is minimized. This strategy leads to an optimized yield by a degree of oxidation that is as low as possible. Since the charge materials usually comprise various oxides in different quantitative proportions, different degrees of conversion of the charge materials occur in metallurgical processes, since, for example, the oxides may be reduced at different rates. The joint optimization by means of an average degree of oxidation has the advantage here that a higher overall efficiency is achieved. Weighted allowance can also be made for the influence of individual oxides.

An advantageous refinement of the method according to the invention provides that the microscopic analysis takes place on the basis of single crystals and/or crystal aggregates of a mineral and/or at least one phase of the charge materials. It has been found that the behavior of the charge materials or their industrial conversion depends very considerably on the phases present and the morphology of the phases, that is to say the geometric formation thereof. It is at the same time necessary that the analysis of the phases is not only averaged over a surface of a charge material but is also performed at the individual crystals and/or aggregates of identical minerals or phases, since, for example and inter alia, the transformation rate is established by the properties of the individual crystals.

An advantageous refinement of the method according to the invention consists in that the microscopic analysis takes place in one or more stages using singly or multiply polarized light. It is possible by the single or multiple analysis with polarized light to identify all the phases from their crystalline properties, to determine their morphology and modal proportions in the charge material as a whole and, as a further consequence, to establish the chemical composition. This procedure allows dependable and rapid identification of the charge materials or their composition and microstructure. The modal proportion is to be understood here as meaning the mineralogical composition of a charge material expressed by the phase components in %.

By the method according to the invention, the multistage microscopic analysis takes place with unpolarized and polarized light, which has a different direction or directions of polarization in different stages. The different polarizer and analyzer positions allow phases to be identified and, in cases of anisotropic phases, the crystal sizes to be determined. The crystal morphology is determined by automatic combination and evaluation of a number of microscopic images with different polarizer-analyzer positions, taken from the same micrograph.

Both analyzers and polarizers are used in many different positions for taking series of images of the same micrograph. The images are processed and compiled by means of software, and consequently the geometric parameters, in particular the crystal boundaries, of a large number of individual anisotropic crystals are determined.

According to an advantageous refinement of the method according to the invention, the crystal and/or phase morphology of the phases identified, in particular the surface area, circumference, circumferential shape, specific circumference, porosity, pore shape and number of pores, are determined and stored in a databank in the form of phase parameters as a basis for the calculation of reference functions. The specific circumference is to be understood as meaning the ratio of the surface area to the circumference. The inverse value of this variable is also known as the hydraulic radius. The phase morphology plays a great role in the conversion, since, for example, diffusion processes or the penetration of process fluids to inner surfaces are influenced by the form, by cavities or cracks. Consequently, knowledge of the morphology, the texture and the structure is an important prerequisite for describing the industrial conversion of the charge materials. Such influences of the morphology on the conversion of the charge materials may also be stored in the form of empirical data or relationships or as functional relationships.

According to a particularly suitable refinement of the method according to the invention, in the case of the microscopic analysis for a single crystal or a crystal cluster of a charge material, Euclidean distances from a surface of the single crystal or the crystal cluster are determined and transformed into a color-graded image, in particular a gray-scale image, and these distances are compiled into a model of concentric shells, the number of shells representing a measure of the duration of the conversion of the charge material in the transformation process. The calculation of the Euclidean distances, which represent distance dimensions, takes place, for example, by the Danielsson method (P. Danielsson, "Euclidean Distance Mapping", Computer Graphics and Image Processing, vol. 14, pp. 227-248, 1980).

The transformation of solid charge materials, such as for example oxides, ores, iron ores, proceeds from the reactive surface of the particles of the charge material, that is to say from the particle surface, and from the pores that are in connection with the surface. To simplify matters, it is first assumed in the case of this process that the advancement of the reduction of a phase takes place approximately at a constant rate and perpendicularly to the respective surface and consequently with constant advancement into the depth of the particles. The model of concentric shells thus allows a description of the advancement of the transformation.

The distance of a position in the particle from the respective grain surfaces therefore represents a measure of the point in time of the transformation in a transformation process. The advancement of a transformation process can consequently be described on the basis of the measured surface area, the circumference and the specific circumference, in each case by taking away the shells of a specific thickness, where the number of shells over time and/or the shell thickness is in a relationship with the rate of transformation of the respective phase. When all the shells have been removed, this corresponds to a complete conversion of the particles. This advancement can be represented as curves which characterize the respective progression of the transformation, and consequently also the progression of the transformation process.

According to the invention, the thickness of each cell is either constant, for simplified calculation, or becomes thinner with increasing distance from the surface, for non-simplified calculation, and is dependent on the charge material and the transformation process, the thickness being determined in empirical tests. If a number of different phases with different transformation rates occur in a charge material, it is sometimes easier first to calculate shells with the same thickness for all the phases and then to consider the relative transformation rates by compiling a number of shells. That phase with the slowest transformation rate has in this case a shell thickness of one pixel, or indeed the smallest compiled shell thickness.

According to a further, advantageous refinement of the method according to the invention, the suitability of a charge material or a mixture of charge materials for a transformation process is assessed on the basis of the microscopic analysis and the comparison with reference functions, in such a way that maximum permissible proportions for individual charge materials are determined. It has been found that individual charge materials must not be used in too high a proportion, because the conversion of the charge materials becomes inadequate or the process times become much longer. For example, inadequate reduction results may occur in the case of the reduction of oxides or, for example, iron ores in the presence of certain iron oxides, such as for example magnetites. Individual phase components can therefore be used as indicators for the conversion in a transformation process, such as a chemical or metallurgical process, so that suitability of the charge materials in a specific composition can be assessed in advance. On the basis of the optical analysis of the charge materials, it is also possible to obtain quantitative findings, and so establish maximum permissible proportions.

According to a special refinement of the method according to the invention, the charge materials are adapted on the basis of the assessment, in particular by mixing different charge materials, with their grain size distribution and/or their composition changing, so that the permissible proportions of the charge materials are not exceeded. On account of the large number of ores, auxiliaries, additions and solid carbon carriers that are usually present, forming the charge materials, it is possible to adapt the composition such that, for example, maximum permissible proportions of individual phases are not exceeded.

According to an alternative refinement of the method according to the invention, two criteria for the suitability of a charge material are respective limits for a specific content of conglutinating grains and/or disintegrating grains during the conversion in the process. If conglutinating grains occur in transformation processes, such as for example in metallurgical processes, this usually leads to disturbances in the process, since, along with reduced conversion, regions in which, for example, only inadequate conversion has taken place may also occur, so that some parts of the charge material are of reduced quality. Similarly, grain disintegration leads to a considerable increase in the proportion of dust, so that, for example, the losses through dust in a metallurgical process can increase greatly. Both effects must therefore be avoided and represent good criteria for the quality of a metallurgical process, since, for example, the extent of the conversion of the charge materials or the extent of a reduction in a reduction process are influenced or determined as a result.

According to an advantageous refinement of the process according to the invention, the transformation process is a reduction process for producing metals, in particular crude iron, and/or primary metallurgical products and/or intermediate metallurgical products using process gases.

According to a further, advantageous refinement of the method according to the invention, the charge materials are carbonaceous and silicaceous rocks, burnt lime, coals and/or cokes and/or ores, in particular iron ores, and/or ore agglomerates, in particular pellets, ore sinters or sintered ores, and/or intermediate metallurgical products, in particular sponge iron, or mixtures thereof. On account of the crystalline properties of the charge materials, they can be identified well by means of the microscopic analysis according to the invention, so that the method can be used for a large number of charge materials.

The invention is further explained below with reference to a non-restrictive example of a reduction process. Reduction processes are usually based on a reducing conversion of, for example, oxidic charge materials, which are treated at high temperatures by means of a hot reduction gas or reducing gas mixtures. The conversion of the charge materials in this case depends, inter alia, on the pressure of the process in the unit used, on the temperature, on the volume flows of the reduction gas and/or the charge materials, on the grain size distribution of the charge materials, on the dwell time of the charge materials in the process, on the degree of oxidation of the process gases and the chemical and mineralogical-petrographic composition of the charge materials. It is, for example, known that the convertibility is also strongly dependent on the morphology of the constituents of the charge materials to be treated. Apart from the chemical composition, therefore the crystalline structure and the form or the distribution of individual phase components of an oxide, for example, are also important influencing variables.

It has been found from empirical tests that certain morphologies of iron oxides have much poorer reducibility, without having a different chemical composition. Added to this is the fact that the presence of individual phase constituents altogether means that there is a similar chemical composition, but has a great effect with regard to the reducibility, that is to say brings about poorer reducibility or else, for example, an increased tendency for the charge materials to disintegrate.

The knowledge of the composition and the exact identification of the charge materials are therefore of great significance for optimum process control or for the control of a metallurgical process, the microscopic identification taking place on the basis of single crystals, crystal aggregates and phases, so that, on the basis of reference functions for these charge materials, information can be used for controlling the metallurgical process. It is advantageous in this case not only that individual phases can be identified but that the form of these phases can also be taken into account. In particular, it is possible to assess the suitability of charge materials and modify them, for example by mixing in other charge materials, in such a way that maximum permissible values for individual charge materials or proportions of these charge materials are not exceeded.

By combination with empirically determined variables, such as for example variables measured on the finished products, parameters which can be used as guide values for controlling the process can be stored. By thermodynamic simulations, which supplement the empirical data, it is possible also to determine functional relationships in the form of reference functions, so that a description of the thermodynamic situation with allowance for the reaction kinetics is possible. Such reference functions allow very accurate and dependable predictions to be made for how the process will progress for the charge materials. Reference functions can therefore be determined in advance for the working range of a metallurgical process, or the charge materials that are to be processed in this process, and stored for the control of the process, so that the control can always refer back to the functional relationships and the empirical data.

Alternatively, it is also conceivable for the thermodynamic simulations with allowance for the reaction kinetics to take place online, that is to say during a process that is in progress. This then opens up the possibility of performing interventions on the basis of the simulated conversion of the charge materials to optimize the process or in the event of disturbances.

DESCRIPTION OF A PREFERRED EMBODIMENT

Figure 1:
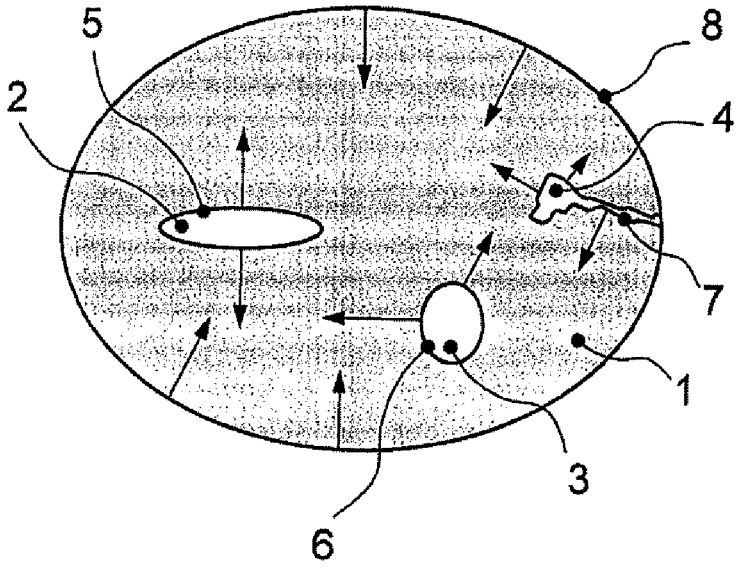
FIG. 1 shows a schematic representation of the advancement of the reaction fronts in a particle of a charge material.

FIG. 1 represents the schematic advancement of a transformation process at an advancing reaction front (represented by arrows). The particle 1 has pores 2, 3, 4 with inner surfaces 5, 6, 7, which may partly also reach as far as the particle surface 8.

The reaction, such as for example a transformation or reduction, proceeds from the reactive surfaces of the particles, that is to say from the particle surface 8 and from pores, such as for example pore 4, which communicate with the particle surface 8. The advancement of the reaction thereby progresses in first approximation at a constant rate and perpendicularly to the respective particle surfaces or inner surfaces and consequently with constant advancement into the depth of the particles.

Figure 2:
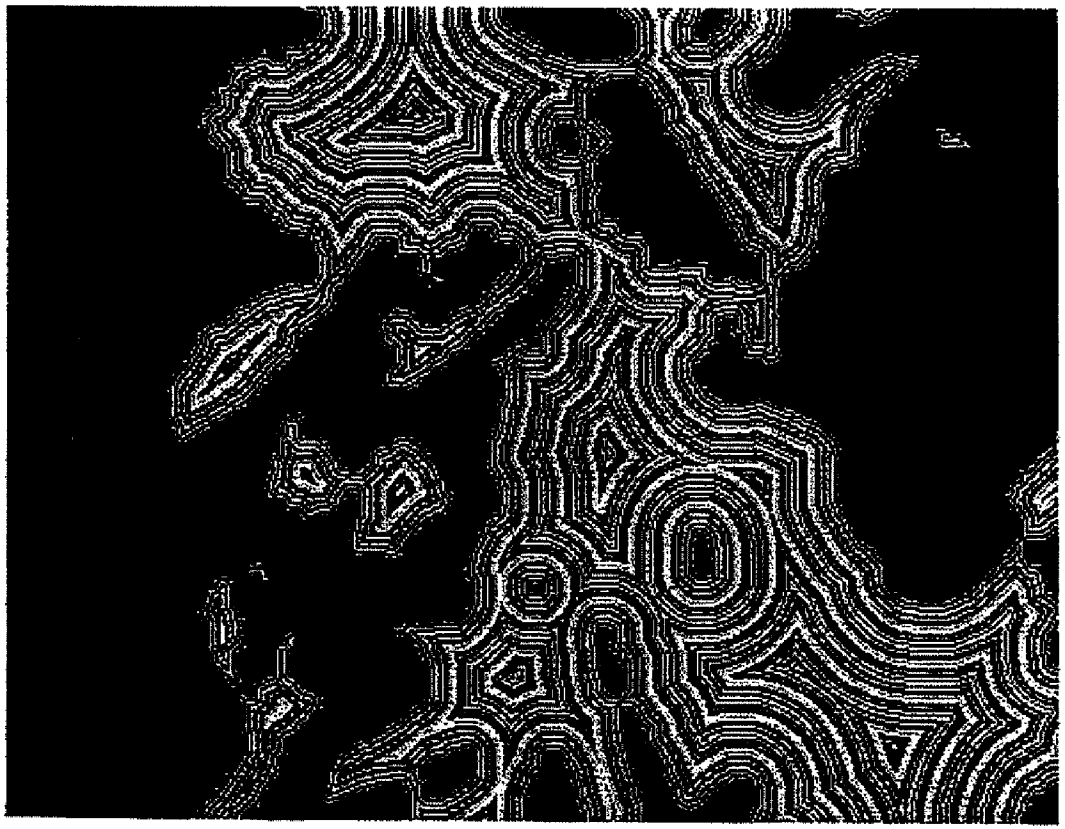
FIG. 2 shows a shell model of a particle of a charge material.

FIG. 2 shows a model of concentric shells of a particle of a charge material, which represents the advancement of the reaction on the basis of the concentric rings.

The particle is represented as concentric shells, with the shells being depicted in different shades of gray. It is possible on the basis of this model to describe a transformation process or the advancement of a reaction front for the particles of a charge material. The model of concentric shells allows for the exact form of the particle including the inner surface, such as cracks and pores.

If a particle of a charge material is made up of different phases with different transformation rates, shells with the same thickness may initially be assumed for all of the phases. The relative transformation rates can be considered by compiling a number of shells. The phase with the slowest transformation rate has in this case the smallest shell thickness.

The invention claimed is:

1. A method for microscopic analysis of charge materials that are for a transformation process, wherein the transformation process is for producing metals
- and/or primary metallurgical products and/or intermediate metallurgical products from the
- charge materials using process gases, the method comprising;
  - microscopically analyzing the charge materials with respect to their phases and/or phase
- components and/or their phase morphology, structure, texture and/or their chemical composition;
  - performing the microscopic analysis in one or more stages using unpolarized and/or
- polarized electromagnetic waves and/or electron microscopy and performing the microscopic
- analysis using polarized light which has a different direction or directions of polarization in
- different ones of the one or more stages;

conducting the microscopic analysis for a single crystal, or a crystal cluster or a phase of a charge material by determining distance dimensions relative to a surface of the single crystal, or the crystal cluster or a phase; and transforming the distance dimensions into a color-graded or a gray-scale image and compiling intervals based on the distance dimensions into a model of concentric shells, wherein the number of shells represents a measure of the duration of the transformation and the thickness of the shells represents a measure of the rate of conversion of the charge material and the phases thereof in the transformation process.

2. The method as claimed in claim 1, further comprising determining a crystal morphology and/or the phase morphology of the phases which phases are selected from the group consisting of surface area, circumference, circumferential shape, specific circumference, porosity, pore shape and number of pores; and storing the determined morphology in a databank in the form of phase parameters as a basis for industrial conversion in the transformation process.

3. The method as claimed in claim 1, wherein the transforming further comprises setting the thickness of each shell which is a measure of the transformation rate wherein the thickness setting is either constant, for simplified calculation, or becomes thinner with increasing distance from the surface and is dependent on the charge material and the transformation process, and the method further comprises determining the thickness of each shell in empirical tests.

4. The method as claimed in claim 1, further comprising assessing the suitability of a charge material or a mixture of charge materials for a transformation process on the basis of the microscopic analysis, and determining maximum permissible proportions for individual charge materials.

5. The method as claimed in claim 1, further comprising performing the microscopic analysis on the basis of single crystals and/or crystal aggregates of a mineral and/or at least one phase of the charge materials.

6. The method as claimed in claim 1, wherein the charge materials are selected from the group consisting of carbonaceous and silicaceous rocks, burnt lime, coals and/or cokes and/or ores, iron ores, and/or ore agglomerates, ore sinters or sintered ores, and/or intermediate metallurgical products, sponge iron, or mixtures of the materials.

7. A transformation process, comprising the method for microscopic analysis as claimed in claim 1, further comprising:

controlling the transformation process by using the microscopic analysis for producing metals and/or primary metallurgical products and/or intermediate metallurgical products using process gases, and converting the charge materials to a product takes place along at least one transformation interface from the crystal and/or grain and/or phase and/or pore surface into the charge material, wherein one or more chemical elements in the charge materials is released and/or incorporated and/or rearranged and the conversion of the charge materials takes place along advancing transformation interfaces.

8. The method is claimed in claim 1, comprising a further calculating step, with respect to the thickness for a number of thin shells that are to be put together to form a thicker shell.

9. The method is claimed in claim 1, wherein the electromagnetic waves are light waves.

* * * * *

UNITED STATES PATENT AND TRADEMARK OFFICE

CERTIFICATE OF CORRECTION

PATENT NO. : 8,665,437 B2
APPLICATION NO. : 12/996421
DATED : March 4, 2014
INVENTOR(S) : Fischer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 323 days.

Signed and Sealed this
Twenty-ninth Day of September, 2015

Michelle K. Lee

Michelle K. Lee
*Director of the United States Patent and Trademark Office*